United States Patent [19]

Doi

[11] 4,037,052

[45] July 19, 1977

[54] SOUND PICKUP ASSEMBLY

[75] Inventor: Toshitada Doi, Yokohama, Japan

[73] Assignee: Sony Corporation, Tokyo, Japan

[21] Appl. No.: 704,841

[22] Filed: July 13, 1976

[30] Foreign Application Priority Data

July 22, 1975 Japan ..... 50-89498

[51] Int. Cl.[2] ..... H04R 1/00

[52] U.S. Cl. ..... 179/1 MF; 179/1 G

[58] Field of Search ..... 179/1 MF, 1 G, 1 GA

[56] References Cited

U.S. PATENT DOCUMENTS

| | | | |
|---|---|---|---|
| 1,299,616 | 4/1919 | Rieber | 179/1 MF |
| 3,305,043 | 2/1967 | Pfund | 179/1 MF |

*Primary Examiner*—Kathleen H. Claffy

*Assistant Examiner*—E. S. Kemeny

*Attorney, Agent, or Firm*—Hill, Gross, Simpson, Van Santen, Steadman, Chiara & Simpson

[57] ABSTRACT

A sound pickup assembly comprising a parabolic reflector in the focal point of which is mounted a pickup and wherein the reverse side of the parabolic reflector is formed as a binaural sound pickup having a pair of microphones mounted on opposite sides of the curved surface generally on a horizontal plane and including a pair of dummy external ears mounted near the pair of microphones such that the pickup can be used as a highly directive pickup utilizing the single microphone and parabolic reflector and wherein the unit can also be utilized for binaural pickup by utilizing the two antennas and dummy ears mounted on the back surface of the unit.

12 Claims, 4 Drawing Figures

SOUND PICKUP ASSEMBLY

BACKGROUND ON THE INVENTION

1. Field of the Invention

This invention relates in general to a sound pickup assembly and more particularly to a novel pickup comprising a parabolic reflector pickup as well as a binaural sound pickup device.

2. Description of the Prior Art

In general, to pick up sound, a single or a pair of microphones are attached to a microphone stand. In order to pick up sound from a distant source effectively, a parabolic reflector is often times employed so as to amplify the sound which is supplied to a microphone as its focal point. For example, a microphone in combination with a parabolic reflector is suitable for picking up sounds from animals or other distant sound sources.

It has also been known in the prior art to have a so-called dummy head stereophonic recording systems which use a dummy head with a pair of microphones placed adjacent the ear positions of such head. Such dummy heads are effective for reproducing sounds by means of particularly headphones. Thus, a listener with headphones can obtain the same effect as if he were in a concert hall and sound sources can be distinguished from nearly all directions and distances with such pickups.

The fundamental reason that the artificial or dummy head stereophonic sound devices are successful is that the sound pressure appearing at the external ears of a dummy head and which are recorded through microphones and then reproduced through a headphone gives very accurate reproduction especially through a two-microphone to ear phone system.

Most dummy heads used generally in the prior art are shaped to appear as a human head, however, when a dummy head simulates the human head very closely, an unpleasant effect is obtained by other persons in the concert hall who observe such dummy heads.

A stethoscope type stereophonic microphone assembly has been used for picking up binaural sound which has an arc-shaped resilient pipe with a microphone mounted at each end of the pipe and with ear mounting projections attached to the microphones for being inserted into the auditory canals of a user and with an output fed out from the center of the resilient pipe. With such an assembly the sound picked up directly at the user's ears has a characteristic which is different depending upon the particular individual ears. Also, when using such devices for a long period of time, the wearer becomes tired and the microphone attachments in his ear are painful. Futhermore, it is difficult for a person wearing such assembly to maintain his head absolutely still and thus the sound pickup will not have the optimum characteristic.

SUMMARY OF THE INVENTION

The present invention provides a sound assembly pickup which comprises a parabolicly shaped sound reflector and a supporting frame for a first microphone attached near the center axis and focal point of the sound reflector and further on the backside of the reflector includes a pair of dummy external ears provided on the peripheral edge of the sound reflector and a pair of microphones attached near the external ears.

It is an object of the present invention to provide a novel sound pickup assembly with a parabolic sound reflector and which also includes a binaural sound pickup.

Yet another object of the invention is to provide a sound pickup assembly with a parabolic sound reflector in which the outer or reverse surface of the parabolic reflector is curved so as to resemble a human face and upon which are mounted a pair of dummy external ears so that the assembly will provide a pickup like a human head.

Another object of the invention is to provide a sound pickup assembly utilizing a parabolic sound reflector which has a pair of dummy external ears mounted on its rear surface and at the peripheral portion of the parabolic reflector and with sound absorbing material attached to the dummy external ears to make it possible that sound can be picked up which would simulate the pickup with human ears.

Yet another object is to provide a sound pickup assembly with a parabolic sound reflector for a single sound pickup or alternatively for binaural sound pickup as desired.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
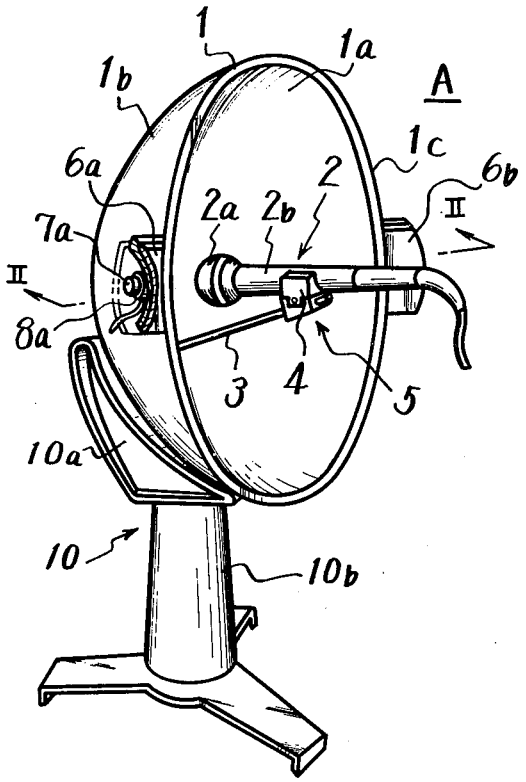
FIG. 1 is a perspective view illustrating an example of the sound pickup assembly according to the invention.
Figure 2:
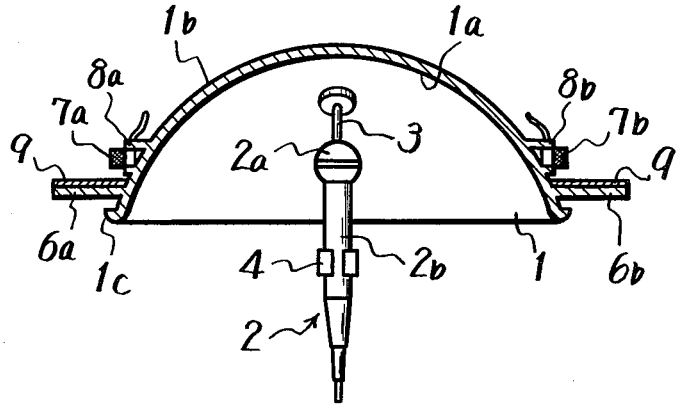
FIG. 2 is a cross-sectional view taken on a horizontal plane line II—II in FIG. 1.

FIGS. 1 and 2 illustrate a first embodiment of the invention comprising a parabolic reflector 1 mounted on a stand 10 so as to form the sound pickup assembly A of the invention. The parabolic reflecting dish 1 may be made of plastic or resin and has a parabolic surface at least on a first side in which a first sound pickup microphone 2 is mounted. The sound pickup microphone 2 is mounted on the sound reflecting member 1 on the concave inner surface 1*a* of the reflecting member 1 at its focus and a supporting rod 3 and attaching member 4 is provided for forming an attaching member for the microphone 2. The supporting member 2*b* of the sound pickup microphone 2 is held by the clamping member 4 of the attaching device 5 so as to locate the head 2*a* of the microphone 2 at the focus of the inner surface 1*a* of the reflector 1.

A pair of dummy external ears (left and right dummy external ears) 6*a* and 6*b* are attached symmetrically on the outer surface 1*b* adjacent the edge 1*c* and are arranged on a generally horizontal plane through the focal point of the reflecting member 1*a*. Behind the dummy external ears 6*a* and 6*b* on the outer surface 1*b* of the reflecting member 1 are provided supporting recesses 8*a* and 8*b* adapted to receive and support a pair of microphones 7*a* and 7*b* in a detachable manner and adjacent the dummy human ears 6*a* and 6*b* so as to obtain the binaural effect of human ears. It is also possible that the dummy human ears 6a and 6b may be formed in a continuous ring 6 which extends completely about the periphery of the reflector 1.

In a particular example the microphones 7a and 7b may be separated by a distance of about 30 to 40 cm and it is possible that the shape or configuration of the dummy human ears 6a and 6b comprise flat projections as shown in the figure but it is preferred that they be shaped similar to human external ears so as to closely duplicate the sound characteristics of a human listener. When the external ears 6a and 6b are made of the same material as that of the reflecting member 1 a sound absorbing sheet material 9 made of, for example, felt or the like should be bonded to the rear surfaces of the dummy ears 6a and 6b on their surface which oppose the microphones 7a and 7b so as to improve the sound characteristics. The microphones 7a and 7b should be non-directional microphones.

The supporting base 10 for the reflecting member 1 comprises an upper support member 10a which connects to the lower half portion of the outer surface 1b of the reflecting member 1 and a stand or leg member 10b which is connected to the attaching member 10a and has a ground stand at its lower end. The supporting rod 3 of the attaching device 5 for the sound pickup microphone 2 passes through the wall of the reflecting member 1 and is then attached to the attaching member 10a of the support 10. The reflecting member 1 is detachably mounted on the attaching member 10a.

The sound pickup assembly of the invention allows the microphone 2a and side 1a of the inner surface of the reflecting member 1 to serve as a sound pickup device or alternatively the rear side 1b and the microphones 6a and 6b to be used as a sound binaural pickup. It is to be realized, of course, that normally the two systems would be alternately used, in other words, one or the other of the systems would be used.

Figure 3:
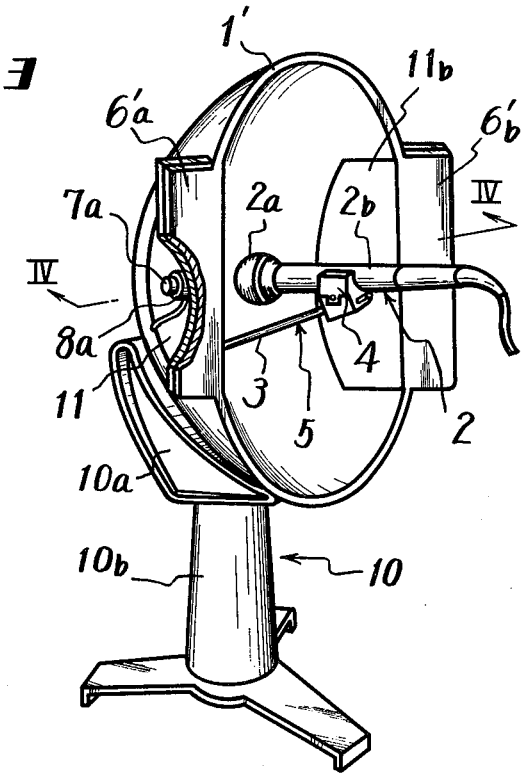
FIG. 3 is a perspective view illustrating a modification of the sound pickup of the invention.
Figure 4:
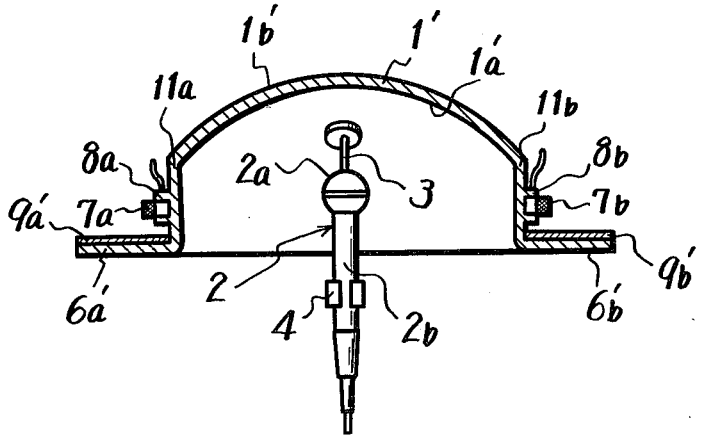
FIG. 4 is a cross-sectional view taken on a horizontal plane on line IV—IV in FIG. 3.

A second embodiment of the invention is illustrated in FIGS. 3 and 4 wherein the sound reflecting member 1' is modified from that illustrated in FIGS. 1 and 2 and wherein planar surfaces 11a and 11b are formed on opposite sides of the reflector as illustrated in FIG. 4 by making indentations in the surface of the reflector 1'. The surfaces 11a and 11b form vertical surfaces and dummy external ears 6a' and 6b' are provided as shown in FIGS. 3 and 4 adjacent the vertical surfaces 11a and 11b and receive thereon a pair of microphones 7a and 7b, respectively. The microphones may be detachably connected to the surfaces 11a and 11b. Sound absorbing sheets 9a' and 9b' are bonded to the rear surfaces of the dummy external ears 6a' and 6b' respectively.

In the example illustrated in FIGS. 3 and 4 the microphones 2a and inner surface 1a' serves as a directive sound pickup device and the back side 1b' and the microphones 7a and 7b serve as the binaural pickup.

Thus, as described above the present invention allows the sound pickup assembly to be used as a sound pickup device by attaching the sound pickup microphone 2 to the inner surface of the reflecting member 1 having a parabolic surface and allows the sound pickup also to be used as a binaural dummy head by providing left and right dummy external ears symmetrically mounted on the outer surface of the reflecting member and by attaching a pair of microphones adjacent the dummy external ears. The outer surface of the reflecting member is convex and simulates the surface of a human face and, thus, the outer surface together with the dummy external ears form a dummy head very similar to a human head. As a result, the assembly of the invention can produce the sound pickup characteristics similar to those of a human head and also the assembly of the invention will not be moved or fluctuate to obtain undersireable sound fluctuations as occur when a stethoscope binaural system is attached to a human head. Thus, binaural sound pickup can occur over long periods of time.

Also, the sound pickup assembly of the invention can perform as a two way sound pickup or can be used as a dummy head and a directive sound pickup device so many various sound pickups can result with the present invention as compared to the prior art devices.

Also, the sound pickup assembly of the invention can be freely transported and moved about and it is suitable for picking up outside sounds.

Although the invention has been described with respect to preferred embodiments it is not to be so limited as changes and modifications may be made which are within the fully intended scope as defined by the appended claims.

I claim as my invention:

1. A sound pickup assembly comprising:

a. a parabolic sound reflecting member having an open edge;

b. means for attaching a first sound pickup microphone near the focus of said reflecting member;

c. dummy external ears mounted to said reflecting member adjacent edge on the side opposite said first microphone; and d. means for supporting second and third left and right sound pickup microphones near said dummy external ears.

2. A sound pickup assembly as claimed in claim 1, in which said dummy external ears are formed of a pair left and right projections provided near said open edge of said reflecting member and are mounted on an imaginary horizontal line.

3. A sound pickup assembly as claimed in claim 1, in which said dummy external ears are formed integrally with said reflecting member and are located on an imaginary horizontal line of said reflecting member.

4. A sound pickup assembly as claimed in claim 1, in which said dummy external ears comprise sound absorbing bodies opposing said means for supporting said left and right sound pickup microphones.

5. A sound pickup assembly as claimed in claim 1, in which said parabolic reflecting member is formed with left and right side vertical faces, and said means for supporting said left and right microphones and said dummy external ears on said vertical faces.

6. A sound pickup assembly as claimed in claim 5, in which said means for supporting said left and right microphones and said dummy external ears are formed integrally with said reflecting member.

7. A sound pickup assembly as claimed in claim 6, in which said dummy external ears have sound absorbing material bonded thereto.

8. A sound pickup assembly comprising:

a. a generally concave dish;

b. a first microphone mounted in said concave dish;

c. a pair of second and third microphones mounted near the outer edges of the back side of said concave dish and aligned horizontally; and d. a pair of dummy external ears attached to said dish adjacent said pair of second and third microphones.

9. A sound pickup assembly according to claim 8 wherein sound reflecting material is mounted on said pair of dummy external ears.

10. A sound pickup assembly according to claim 8 wherein said pair of second and third microphones are mounted on vertical planar portions formed in said dish on opposite sides thereof.

11. A sound pickup assembly according to claim 10 wherein said dummy external ears are formed as outwardly extending members from said vertical planar portions.

12. A sound pickup assembly according to claim 11 wherein sound reflecting material attached to said outwardly extending members.

* * * * *